US011842670B2

(12) United States Patent
Lee et al.

(10) Patent No.: US 11,842,670 B2
(45) Date of Patent: Dec. 12, 2023

(54) ELECTRONIC DEVICE FOR DYNAMICALLY ADJUSTING REFRESH RATE OF DISPLAY

(71) Applicant: Samsung Electronics Co., Ltd., Suwon-si (KR)

(72) Inventors: Seoyoung Lee, Suwon-si (KR); Minwoo Lee, Suwon-si (KR); Juseok Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/086,007

(22) Filed: Dec. 21, 2022

(65) Prior Publication Data

US 2023/0123776 A1 Apr. 20, 2023

Related U.S. Application Data

(63) Continuation of application No. PCT/KR2021/007898, filed on Jun. 23, 2021.

(30) Foreign Application Priority Data

Jun. 23, 2020 (KR) ..... 10-2020-0076470

(51) Int. Cl.
*G09G 3/20* (2006.01)
*G09G 5/39* (2006.01)

(52) U.S. Cl.
CPC ..... *G09G 3/2096* (2013.01); *G09G 5/39* (2013.01); *G09G 2310/08* (2013.01); (Continued)

(58) Field of Classification Search
CPC .... G09G 3/2096; G09G 5/39; G09G 2310/08; G09G 2320/0247; G09G 2340/0435; G09G 2360/18
See application file for complete search history.

(56) References Cited

U.S. PATENT DOCUMENTS 8,582,033 B2 * 11/2013 Sawada ..... G09G 5/008 348/516
9,013,386 B2 * 4/2015 Tsai ..... G09G 3/3648 345/87

(Continued)

FOREIGN PATENT DOCUMENTS

JP 2017-069713 A 4/2017
JP 2017-194509 A 10/2017

(Continued)

OTHER PUBLICATIONS

International Search Report dated Oct. 1, 2021, issued in International Patent Application No. PCT/KR2021/007898.

*Primary Examiner* — Gene W Lee
(74) *Attorney, Agent, or Firm* — Jefferson IP Law, LLP

(57) ABSTRACT

An electronic device is provided. The electronic device includes a memory, a display driver integrated circuit (DDIC), a display, and a processor that generates an image frame, transmits the image frame to the DDIC, and controls the DDIC to drive the display based on the image frame. The DDIC outputs a first timing signal at a first frame period, outputs a second timing signal at a second frame period longer than the first frame period when the reception of the image frame is delayed, and outputs a third timing signal at a third frame period longer than the first frame period and shorter than the second frame period when the image frame is not received for a designated reference time after the second timing signal is output.

15 Claims, 9 Drawing Sheets

(52) U.S. Cl.
CPC ..... *G09G 2320/0247* (2013.01); *G09G 2340/0435* (2013.01); *G09G 2360/18* (2013.01)

(56) References Cited

U.S. PATENT DOCUMENTS

| | | | | |
|---|---|---|---|---|
| 9,514,511 | B2 | 12/2016 | Lee et al. | |
| 10,629,159 | B2 * | 4/2020 | Ueda | G09G 3/288 |
| 2015/0130824 | A1 | 5/2015 | Lee et al. | |
| 2015/0138212 | A1 | 5/2015 | Bae et al. | |
| 2015/0379665 | A1 | 12/2015 | Kwa et al. | |
| 2017/0193971 | A1 | 7/2017 | Bi et al. | |
| 2018/0247616 | A1 | 8/2018 | Glen et al. | |
| 2019/0340973 | A1 | 11/2019 | Kim | |
| 2023/0040656 | A1 * | 2/2023 | Wai | G09G 3/3291 |

FOREIGN PATENT DOCUMENTS

| | | | |
|---|---|---|---|
| KR | 10-2005-0060033 | A | 6/2005 |
| KR | 10-2015-0134772 | A | 12/2015 |
| KR | 10-2016-0146972 | A | 12/2016 |
| KR | 10-1885331 | A | 8/2018 |
| KR | 10-2019-0128031 | A | 11/2019 |
| KR | 10-2017-0080232 | A | 7/2022 |
| WO | WO-2018207298 | A1 * | 11/2018 |

* cited by examiner

∴ m2 > m3

ELECTRONIC DEVICE FOR DYNAMICALLY ADJUSTING REFRESH RATE OF DISPLAY

CROSS-REFERENCE TO RELATED APPLICATION(S)

This application is a continuation application, claiming priority under § 365(c), of an International application No. PCT/KR2021/007898, filed on Jun. 23, 2021, which is based on and claims the benefit of a Korean patent application number 10-2020-0076470, filed on Jun. 23, 2020, in the Korean Intellectual Property Office, the disclosure of which is incorporated by reference herein in its entirety.

BACKGROUND

1. Field

The disclosure relates to an electronic device that dynamically control a refresh rate of a display.

2. Description of Related Art

An electronic device may display various screens such as an image, text, and the like such as a display panel.

A mobile industry processor interface-display serial interface (MIPI DSI) may be the display standard for a portable electronic device such as a smartphone, a tablet personal computer (PC), a smart watch, or the like.

The mobile industry processor interface (MIPI) is the display standard, and may include a video mode and a command mode.

In the video mode, a host (e.g., a processor) may transmit an image frame to a display driver integrated circuit (IC) in real time. For example, in the video mode, in the case that an image to be displayed in a display panel is a still image, the host may repeatedly transmit the same image frame corresponding to the still image to the display driver IC.

In the command mode, the start of transmission of an image frame may be controlled by a tearing effect (TE) signal output from the display driver IC. Based a timing signal (e.g., TE signal) output from the display driver IC, a host (e.g., a processor) may control the transmission timing (e.g., refresh rate) of an image frame transmitted to the display driver IC.

The above information is presented as background information only to assist with an understanding of the disclosure. No determination has been made, and no assertion is made, as to whether any of the above might be applicable as prior art with regard to the disclosure.

SUMMARY

A portable electronic device is being developed to increase the resolution of a display panel and to support operation of high-speed frequency (e.g., 60 Hz to 120 Hz). Therefore, an operation of rendering an image frame by a host (e.g., a processor) may be delayed, and the delay may cause motion judder on the display panel.

Aspects of the disclosure are to address at least the above-mentioned problems and/or disadvantages and to provide at least the advantages described below. Accordingly, an aspect of the disclosure is to provide an electronic device that dynamically adjusts the refresh rate of a display based on detection of delay of image frame transmission by a host (e.g., a processor), thereby preventing image degradation.

Additional aspects will be set forth in part in the description which follows and, in part, will be apparent from the description, or may be learned by practice of the presented embodiments.

In accordance with an aspect of the disclosure, an electronic device is provided. The electronic device includes a memory configured to store an application, a display driver IC, a display, and a processor, and the processor is configured to execute an application, to produce an image frame corresponding to an execution screen of the application, to transmit the image frame to a display driver IC in response to a timing signal output from the display driver IC, and to perform control so that the display driver IC operates the display based on the image frame, and the display driver IC is configured to output a first timing signal at designated first frame intervals, to output a second timing signal at designated second frame intervals longer than the first frame interval in the case that reception of the image frame from the processor is delayed, and to output a third timing signal at designated third frame intervals longer than the first frame interval and shorter than the second frame interval in the case that the image frame is not received from the processor within a designated reference time from the point in time at which the second timing signal is output.

In accordance with another aspect of the disclosure, a method of operating an electronic device including a display driver IC and a processor is provided. The method includes an operation of producing, by the processor, an image frame corresponding to an execution screen of an application, an operation of transmitting, by the processor, the image frame to the display driver IC in response to a timing signal output from the display driver IC, and an operation of operating, by the display driver IC, the display based on the image frame, and the operation of outputting of the timing signal by the display driver IC may include an operation of outputting a first timing signal at designated first frame intervals, an operation of outputting a second timing signal at designated second frame intervals longer than the first frame interval in the case that reception of the image frame from the processor is delayed, and an operation of outputting a third timing signal at designated third frame intervals longer than the first frame interval and shorter than the second frame interval in the case that the image frame is not received from the processor within a designated reference time from the point in time at which the second timing signal is output.

An electronic device according to various embodiments of the disclosure may dynamically adjust the refresh rate of a display based on detection of delay of image frame transmission by a host (e.g., a processor), thereby preventing image degradation.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
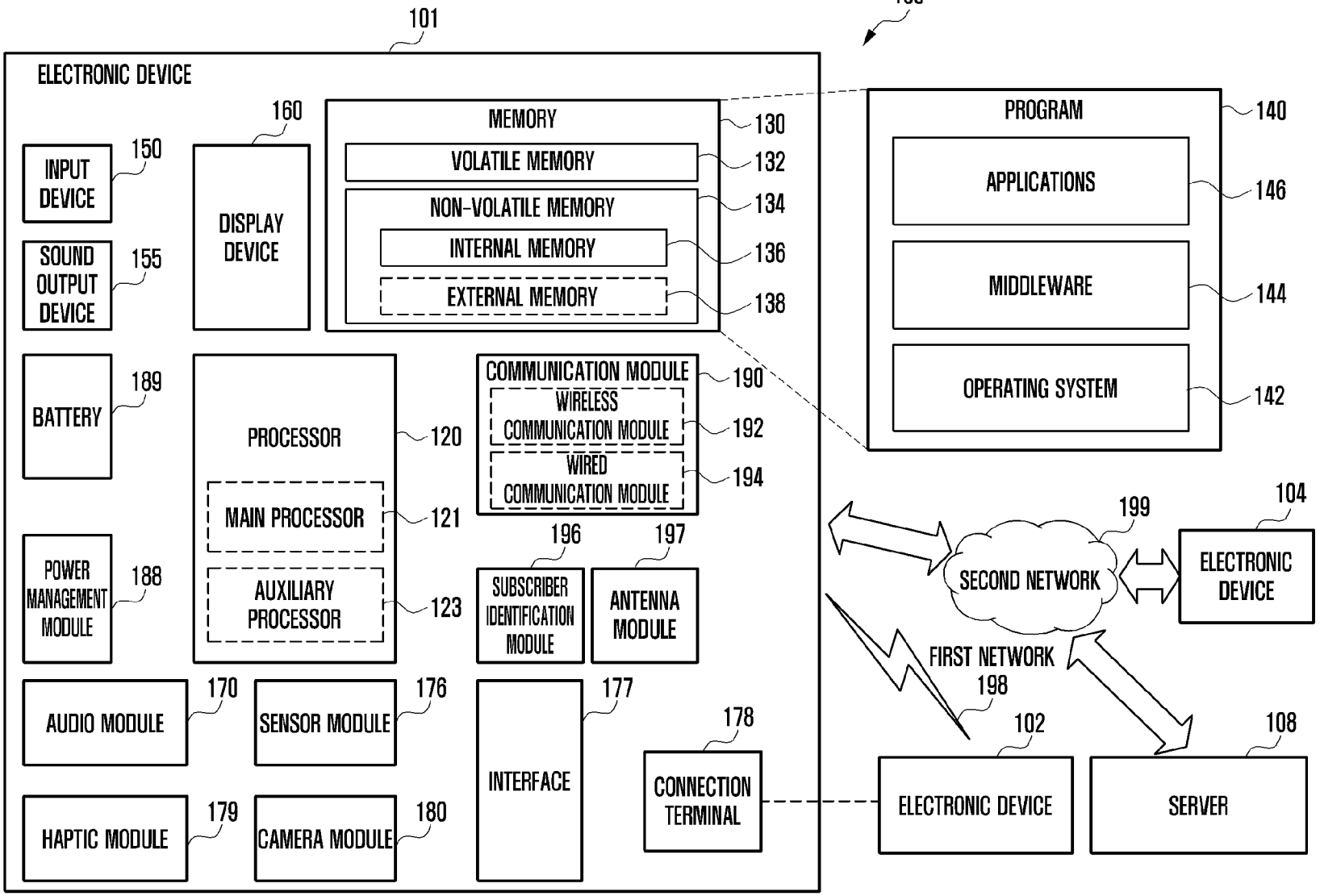
FIG. 1 is a block diagram illustrating an electronic device in a network environment according to an embodiment of the disclosure.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (e.g., a short-range wireless communication network), or at least one of an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a connection terminal 178, a haptic module 179, a camera module 180, a power management module 188, a battery 189, a communication module 190, a subscriber identification module (SIM) 196, or an antenna module 197. In some embodiments, at least one of the components (e.g., the connection terminal 178) may be omitted from the electronic device 101, or one or more other components may be added in the electronic device 101. In some embodiments, some of the components (e.g., the sensor module 176, the camera module 180, or the antenna module 197) may be implemented as a single component (e.g., the display device 160).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may store a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), or an auxiliary processor 123 (e.g., a graphics processing unit (GPU), a neural processing unit (NPU), an image signal processor (ISP), a sensor hub processor, or a communication processor (CP)) that is operable independently from, or in conjunction with, the main processor 121. For example, when the electronic device 101 includes the main processor 121 and the auxiliary processor 123, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123. According to an embodiment, the auxiliary processor 123 (e.g., the neural processing unit) may include a hardware structure specified for artificial intelligence model processing. An artificial intelligence model may be generated by machine learning. Such learning may be performed, e.g., by the electronic device 101 where the artificial intelligence is performed or via a separate server (e.g., server 108). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, a key (e.g., a button), or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include a touch sensor adapted to detect a touch, or a pressure sensor adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

The connection terminal 178 may include a connector via which the electronic device 101 may be physically connected with the external electronic device (e.g., electronic device 102). According to an embodiment, the connection terminal 178 may include, for example, a HDMI connector, a USB connector, an SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., electronic device 102, electronic device 104, or server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a legacy cellular network, a fifth generation (5G) network, a next-generation communication network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The wireless communication module 192 may support a 5G network, after a fourth generation (4G) network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 192 may support a high-frequency band (e.g., the millimeter wave (mmWave) band) to achieve, e.g., a high data transmission rate. The wireless communication module 192 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 192 may support various requirements specified in the electronic device 101, an external electronic device (e.g., electronic device 104), or a network system (e.g., the second network 199). According to an embodiment, the wireless communication module 192 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., a printed circuit board (PCB)). According to an embodiment, the antenna module 197 may include a plurality of antennas (e.g., array antennas). In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

According to various embodiments, the antenna module 197 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 or 104 may be a device of a same type as, or a different type, from the electronic device 101. According to an embodiment, all or some of operations to be executed at the electronic device 101 may be executed at one or more of the external electronic devices 102 and 104 or the server 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, mobile edge computing (MEC), or client-server computing technology may be used, for example. The electronic device 101 may provide ultra low-latency services using, e.g., distributed computing or mobile edge computing. In another embodiment, the external electronic device 104 may include an internet-of-things (IoT) device. The server 108 may be an intelligent server using machine learning and/or a neural network. According to an embodiment, the external electronic device 104 or the server 108 may be included in the second network 199. The electronic device 101 may be applied to intelligent services (e.g., smart home, smart city, smart car, or healthcare) based on 5G communication technology or IoT-related technology.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively," as "coupled with," "coupled to," "connected with," or "connected to" another element (e.g., a second element), it denotes that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, "logic," "logic block," "part," or "circuitry." A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply denotes that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
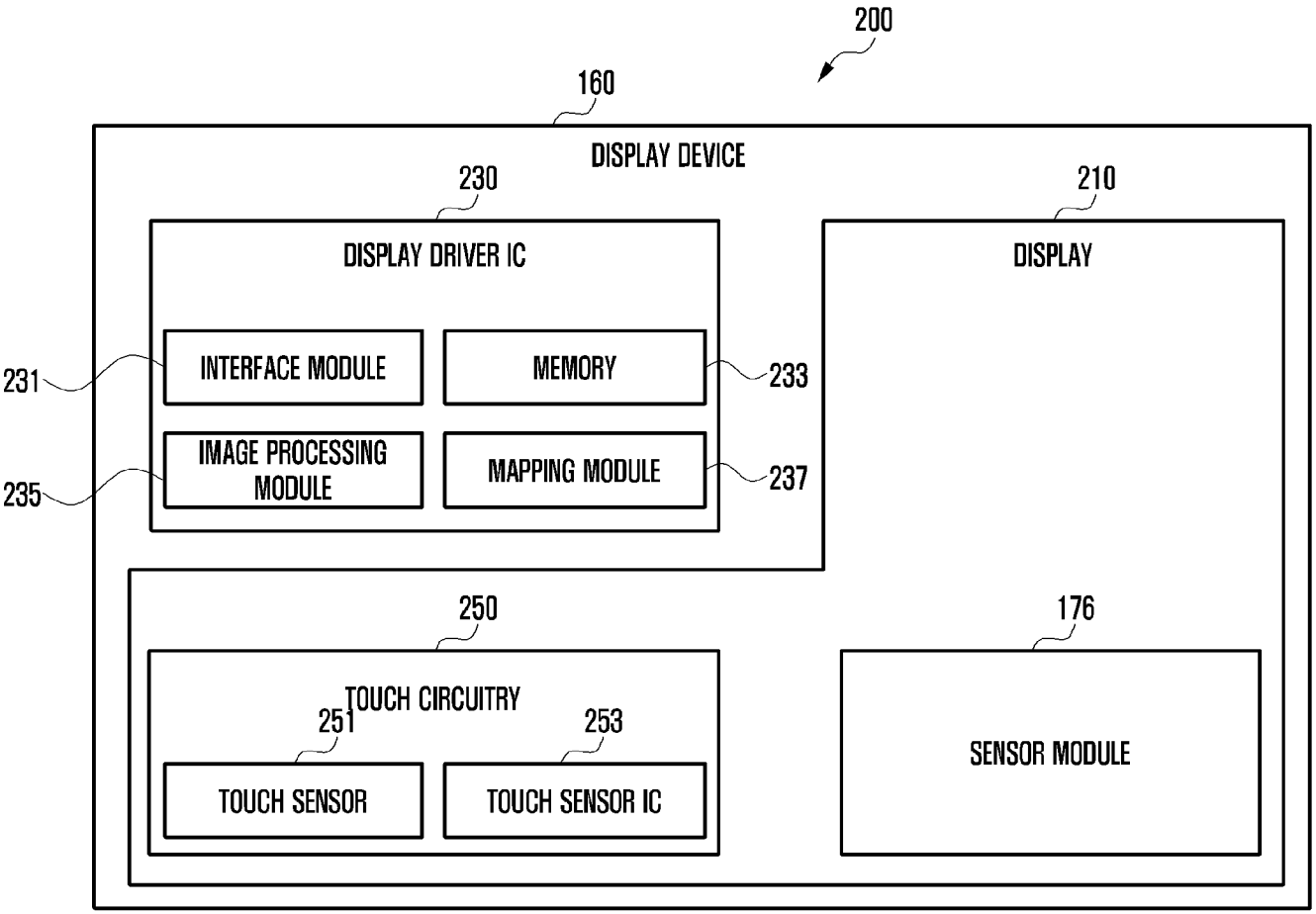
FIG. 2 is a block diagram of a display device according to an embodiment of the disclosure.

FIG. 2 is a block diagram 200 of a display device according to an embodiment of the disclosure.

Referring to FIG. 2, a display device 160 may include a display 210 and a display driver IC 230 (hereinafter, referred to as "DDIC 230") configured to control the display 210.

The DDIC 230 may include an interface module 231, a memory 233 (e.g., a buffer memory), an image processing module 235, and/or a mapping module 237.

According to an embodiment, the DDIC 230 may receive image data or image information including an image control signal corresponding to a command for controlling the image data from another component of the electronic device (e.g., the electronic device 101 in FIG. 1 via the interface module 231.

According to an embodiment, the image information may be received from a processor (e.g., the processor 120 in FIG. 1) (e.g., the main processor 121 in FIG. 1)) (e.g., an application processor), or an auxiliary processor 123 (e.g., the auxiliary processor 123 in FIG. 1) (e.g., a graphics processing device) operated independently from the function of the main processor 121.

According to an embodiment, the DDIC 230 may communicate with touch circuitry 250 or the sensor module 176 via the interface module 231. In addition, the DDIC 230 may store at least a part of the received image information in the memory 233. As an example, the DDIC 230 may store at least a part of the received image information in the memory 233 in units of frames.

According to an embodiment, the image processing module 235 may perform pre-processing or post-processing (e.g., adjustment of resolution, brightness, or size) on at least a part of the image data based at least on characteristics of the video data or the characteristics of the display 210.

According to an embodiment, the mapping module 237 may generate a voltage value or a current value corresponding to the image data pre-processed or post-processed via the image processing module 235. As an embodiment, the generation of the voltage value or the current value may be performed based at least on, for example, the attributes of the pixels of the display 210 (e.g., the array of pixels (a red green blue (RGB) stripe or PenTile structure), the size of each of sub-pixels, or deterioration of pixels).

As an example, at least some of the pixels of the display 210 are driven based at least partially on the voltage value or the current value, so that visual information (e.g., text, images, or icons) corresponding to the video data can be displayed through the display 210.

According to an embodiment, the display device 160 may further include the touch circuitry 250. The touch circuitry 250 may include a touch sensor 251 and a touch sensor IC 253 configured to control the touch sensor 251.

As an embodiment, the touch sensor IC 253 may control the touch sensor 251 to detect a touch input or a hovering input with respect to a specific position in the display 210. For example, the touch sensor IC 253 may detect a touch input or a hovering input by measuring a change in a signal (e.g., voltage, light amount, resistance, or charge amount) with respect to a specific position in the display 210. The touch sensor IC 253 may provide a processor (e.g., the processor 120 in FIG. 1) with information about the detected touch input or hovering input (e.g., position, area, pressure, or time).

According to an embodiment, at least a part of the touch circuitry 250 (e.g., touch sensor IC 253) may be included as a part of the DDIC 230 or the display 210.

According to an embodiment, at least a part of the touch circuitry 250 (e.g., touch sensor IC 253) may be included as a part of another component (e.g., the auxiliary processor 123) disposed outside the display device 160.

According to an embodiment, the display device 160 may further include the sensor module 176 and/or a control circuit for the sensor module 176. The sensor module 176 may include at least one sensor (e.g., a camera module, an illumination sensor, a fingerprint sensor, an iris sensor, a pressure sensor, and/or an image sensor). In this case, the at least one sensor or a control circuitry for the same may be embedded in a part of the display device 160 (e.g., the display 210 or the DDIC 230) or a part of touch circuitry 250.

According to an embodiment, when the sensor module 176 includes a camera module (e.g., an image sensor), the camera module (e.g., the image sensor) may be arranged below (e.g., under) the display in an under-display camera (UDC) manner.

Figure 3:
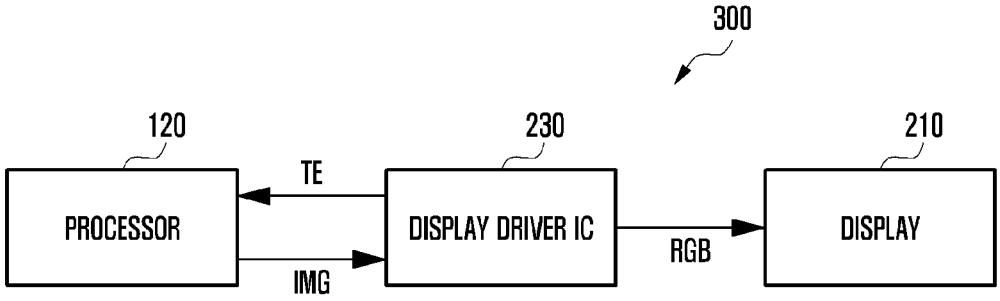
FIG. 3 is a block diagram of an electronic device according to an embodiment of the disclosure.

FIG. 3 is a block diagram of an electronic device according to an embodiment of the disclosure. At least one of elements of the electronic device 300 illustrated in FIG. 3 may be at least partially similar to the electronic device 101 of FIG. 1 and/or the display device 160 of FIG. 2, or may further include another embodiment.

Referring to FIG. 3, an electronic device 300 according to an embodiment may include the processor 120 (e.g., the processor 120 of FIG. 1), the display driver IC 230 (hereinafter referred to as a DDIC) (e.g., the DDIC 230 of FIG. 2), or the display 210 (e.g., the display device 160 of FIG. 1). The electronic device 300 according to an embodiment may operate based on a command mode which is the display standard provided from an MIPI. For example, the electronic device 300 may include the processor 120 and the DDIC 230, and the processor 120 may act as a host.

According to an embodiment, the processor 120 may transmit an image frame (IMG) to the DDIC 230 based on a timing signal (TE) (e.g., tearing effect (TE) signal) output from the DDIC 230. For example, the driving frequency (e.g., refresh rate) at which the electronic device 300 operates the display 210 may be controlled based on a timing signal (TE) output from the DDIC 230. The term used in the document, "timing signal (TE)" may be a tearing effect (TE) signal used in the MIPI standard.

According to an embodiment, the processor 120 may execute an application, and may sequentially render a plurality of image frames (IMG) corresponding to an execution screen of the executed application. For example, the processor 120 may sequentially render image frames (IMG) (e.g., IMG0, IMG1, IMG2 of FIG. 6) corresponding to the execution screen.

According to an embodiment, the processor 120 may transmit image frames (IMG) of which rendering has been completed to the DDIC 230 in response to the timing signal (TE). For example, the processor 120 may sequentially transmit image frames (IMG) (e.g., IMG0, IMG1, IMG2 of FIG. 6) corresponding to the execution screen.

According to an embodiment, the DDIC 230 may operate the display 210 (e.g., a display panel) based on a received image frame (IMG). For example, the DDIC 230 may operate the display 210 to display an image frame (IMG) received from the processor 120. According to an embodiment, the DDIC 230 may arrange a received image frame (IMG) to be appropriate for the characteristic (e.g., resolution) of a display panel, and/or may perform pre-processing or post-processing (e.g., adjustment of a resolution, a brightness, or a size) on the image frame (IMG) based on the characteristic of the display 210, so as to produce a converted image frame (RGB). The DDIC 230 may operate the display 210 to display the converted image frame (RGB).

According to an embodiment, the DDIC 230 may output a timing signal (TE) so as to determine a timing at which the processor 120 is to transmit an image frame (IMG). For example, in the electronic device 300 that operates in the command mode of the MIPI, a timing signal (TE) may be a signal that the DDIC 230 indicates, to a host (e.g., the processor 120), a transmission timing of an image frame (IMG). According to an embodiment, the processor 120 that is a host may transmit an image frame (IMG) to the DDIC 230 in response to a timing signal (TE) output from the DDIC 230.

In the case that transmission of an image frame (IMG) from the processor 120 is delayed, the DDIC 230 according to an embodiment may control the output cycle and/or length of a timing signal (TE). For example, by increasing the output cycle and/or length of a timing signal (TE), the DDIC 230 may increase a timing at which the processor 120 is capable of transmitting an image frame (IMG) to the DDIC 230. Therefore, the DDIC 230 may relatively promptly receive a new image frame (IMG), and the electronic device 300 according to an embodiment may decrease image degradation (e.g., flicker).

According to an embodiment, the processor 120 and/or DDIC 230 may control various interfaces. For example, an interface may include an MIPI, a mobile display digital interface (MDDI), or a compact display port (CDP). According to an embodiment, the DDIC 230 may include a graphic memory (hereinafter, 'GRAM'). According to an embodiment, the DDIC 230 may reduce the amount of current consumed and may reduce the load of the processor 120 using the GRAM. The GRAM may write data (e.g., a converted image frame (RGB)) via the processor 120, and may output the written data via a scan operation. According to an embodiment, the GRAM may be embodied as a dual-port DRAM.

According to an embodiment, the display 210 may display, in units of frames, an image frame (RGB) converted according to control by the DDIC 230. For example, the display 210 may include at least one of an organic light emitting display panel (OLED), a liquid crystal display panel (LCD), a plasma display panel (PDP), an electrophoretic display panel, and/or an electrowetting display panel.

Figure 6:
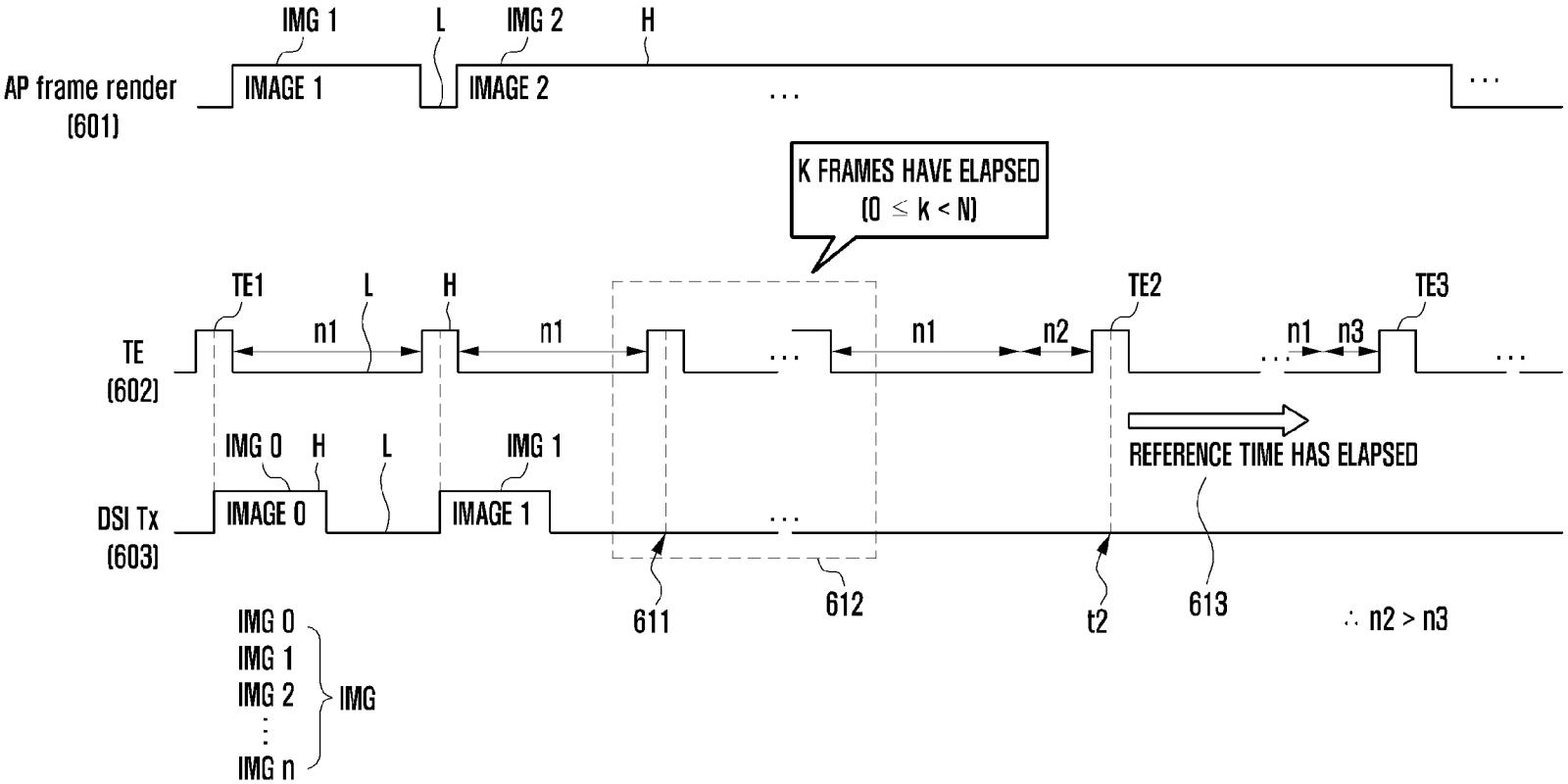
FIG. 6 is a graph illustrating an operation timing of an electronic device according to an embodiment of the disclosure.

An electronic device (e.g., the electronic device 300 of FIG. 3) according to various embodiments of the disclosure may include a memory (e.g., the memory 130 of FIG. 1) storing an application, a display driver IC (e.g., the display driver IC 230 of FIG. 3), a display (e.g., the display 210 of FIG. 3), and a processor (e.g., the processor 120 of FIG. 1), and the processor 120 may be configured to execute an application, to produce an image frame corresponding to an execution screen of the application, to transmit the image frame to the display driver IC 230 in response to a timing signal output from the display driver IC 230, and to perform control so that the display driver IC 230 operates the display 210 based on the image frame, and the display driver IC 230 may be configured to output a first timing signal (e.g., a first timing signal (TE1) of FIG. 6) at designated first frame intervals, to output a second timing signal (e.g., a second timing signal (TE2) of FIG. 6) at designated second frame intervals longer than the first frame interval in the case that reception of the image frame from the processor 120 is delayed, and to output a third timing signal (e.g., a third timing signal (TE3) of FIG. 6) at designated third frame intervals longer than the first frame interval and shorter than the second frame interval in the case that the image frame is not received from the processor 120 within a designated reference time from the point in time at which the second timing signal (TE2) is output.

When the image frame is not received from the processor 120 within a designated period of time from the point in time at which the first timing signal (TE1) is output, the display driver IC 230 according to various embodiments of the disclosure may output the second timing signal (TE2).

According to various embodiments of the disclosure, when the image frame is received from the processor 120 while the second timing signal (TE2) is output, the display driver IC 230 may output the first timing signal (TE1) at the first frame intervals.

According to various embodiments of the disclosure, when the image frame is received from the processor 120 while the third timing signal (TE3) is output, the display driver IC 230 may output the first timing signal (TE1) at the first frame intervals.

According to various embodiments of the disclosure, the display driver IC 230 may include a buffer memory storing a previously received image frame, and the display driver IC 230 may operate the display 210 to display the previously received image frame in the case that reception of the image frame from the processor 120 is delayed.

According to various embodiments of the disclosure, the processor 120 and the display driver IC 230 may be connected via a mobile industry processor interface-display serial interface (MIPI DSI), and the timing signal may be a tearing effect (TE) signal.

According to various embodiments of the disclosure, the second frame interval may be a threshold value at which flicker is not visible while the display 210 displays a video.

According to various embodiments of the disclosure, the third frame interval may be a threshold value at which flicker is not visible while the display 210 displays a still image.

According to various embodiments of the disclosure, an enable section of the first timing signal (TE1) may have a first length (EN1), an enable section of the second timing signal (TE2) may have a second length (EN2) longer than the first length (EN1), and an enable section of the third timing signal (TE3) may have a third length (EN3) longer than the first length (EN1) and shorter than the second length (EN2).

According to various embodiments of the disclosure, the second length (EN2) may be a threshold value at which flicker is not visible while the display displays a video.

According to various embodiments of the disclosure, the third length (EN3) may be a threshold value at which flicker is not visible while the display 210 displays a still image.

Figure 9:
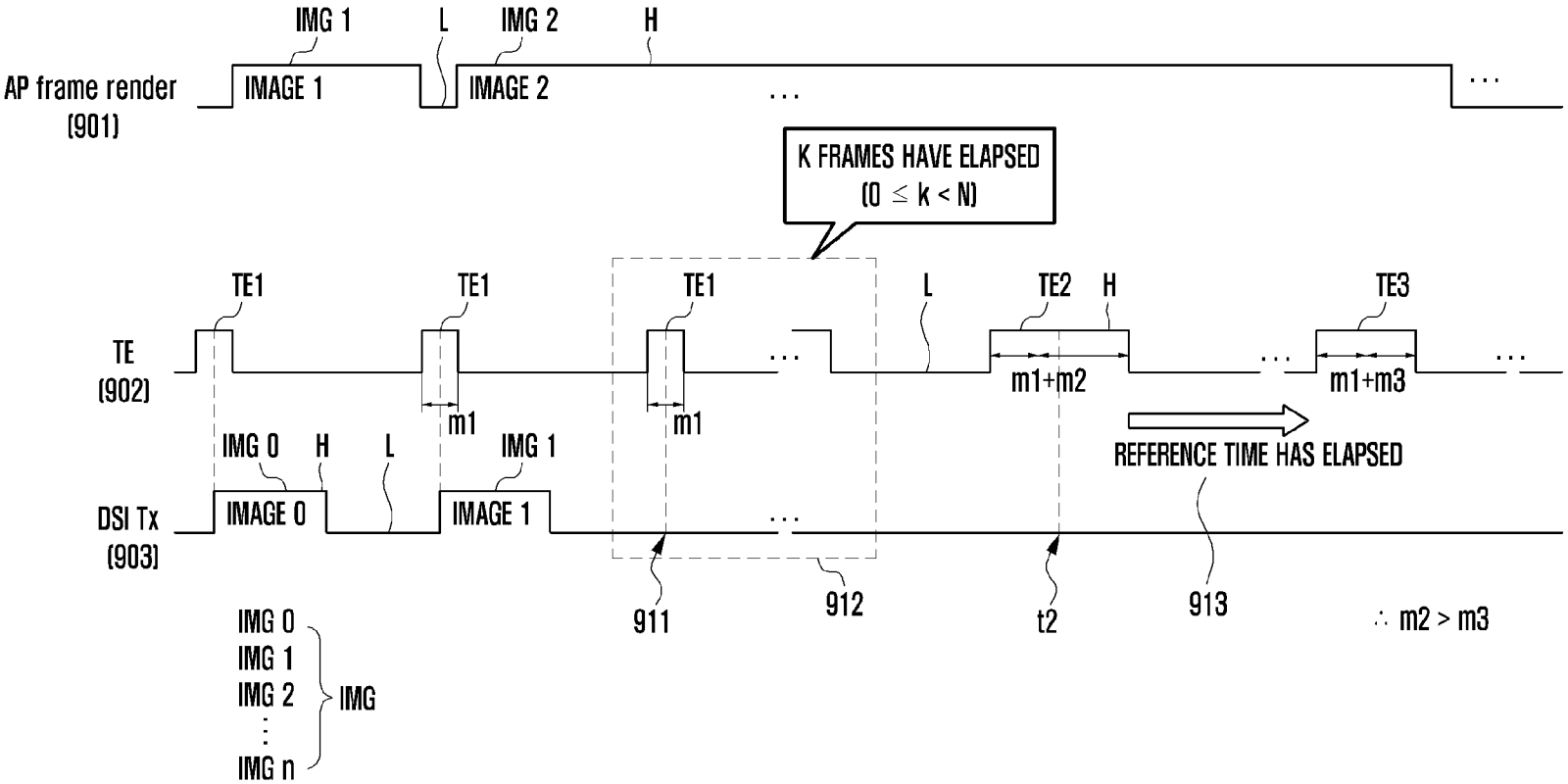
FIG. 9 is a graph illustrating an operation timing of an electronic device according to an embodiment of the disclosure.

The electronic device 300 according to various embodiments of the disclosure may include a memory storing an application, the display driver IC 230, the display 210, and the processor 120, and the processor 120 may be configured to execute an application, to produce an image frame corresponding to an execution screen of the application, to transmit the image frame to the display driver IC 230 in response to a timing signal output from the display driver IC 230, and to perform control so that the display driver IC 230 operates the display 210 based on the image frame, and the display driver IC 230 may be configured to output a first timing signal (e.g., a first timing signal (TE1) of FIG. 9) having an enable section of a designated first length (EN1), to output a second timing signal (e.g., a second timing signal (TE2) of FIG. 9) having an enable section of a designated second length (EN2) longer than the first length (EN1) in the case that reception of the image frame from the processor 120 is delayed, and to output a third timing signal (e.g., a third timing signal (TE3) of FIG. 9) having an enable section of a designated third length (EN3) longer than the first length (EN1) and shorter than the second length (EN2) in the case that the image frame is not received from the processor 120 within a designated reference time from the point in time at which the second timing signal (TE2) is output.

According to various embodiments of the disclosure, when the image frame is received from the processor 120 while the second timing signal (TE2) or the third timing signal (TE3) is output, the display driver IC 230 may output the first timing signal (TE1).

According to various embodiments of the disclosure, the second length (EN2) may be a threshold value at which flicker is not visible while the display 210 displays a video.

According to various embodiments of the disclosure, the third length (EN3) may be a threshold value at which flicker is not visible while the display 210 displays a still image.

According to various embodiments of the disclosure, the first timing signal (TE1) is output at designated first frame intervals, the second timing signal (TE2) is output at designated second frame intervals longer than the first frame interval, and the third timing signal (TE3) is output at designated third frame intervals longer than first frame interval and shorter than the second frame interval.

According to various embodiments of the disclosure, the second frame interval may be a threshold value at which flicker is not visible while the display 210 displays a video.

According to various embodiments of the disclosure, the third frame interval may be a threshold value at which flicker is not visible while the display 210 displays a still image.

A method of operating the electronic device 300 including the display driver IC 230 and the processor 120 may include an operation of producing, by the processor 120, an image frame corresponding to an execution screen of an application, and an operation of transmitting, by the processor 120, the image frame to the display driver IC 230 in response to a timing signal output from the display driver IC 230, and an operation of operating, by the display driver IC 230, the display 210 based on the image frame, and the operation of outputting the timing signal by the display driver IC 230 may include an operation of outputting a first timing signal (TE1) at designated first frame intervals, an operation of outputting a second timing signal (TE2) at designated second frame intervals longer than the first frame interval in the case that reception of the image frame from the processor 120 is delayed; and an operation of outputting a third timing signal (TE3) at designated third frame intervals longer than the first frame interval and shorter than the second frame interval in the case that the image frame is not received from the processor 120 within a designated reference time from the point time at which the second timing signal (TE2) is output.

A method of operating the electronic device 300 including the display driver IC 230 and the processor 120 according to various embodiments of the disclosure may include an operation of producing, by the processor 120, an image frame corresponding to an execution screen of an application, and an operation of transmitting, by the processor 120, the image frame to the display driver IC 230 in response to a timing signal output from the display driver IC 230, and an operation of operating, by the display driver IC 230, the display 210 based on the image frame, and the operation of outputting the timing signal by the display driver IC 230 may include an operation of outputting a first timing signal (TE1) having an enable section of a designated first length (EN1), an operation of outputting a second timing signal (TE2) having an enable section of a designated second length (EN2) longer than the first length (EN1) in the case that reception of the image frame from the processor 120 is delayed, and an operation of outputting a third timing signal (TE3) having an enable section of a designated third length (EN3) longer than the first length and shorter than the second length in the case that the image frame is not received from the processor 120 within a designated reference time from the point time at which the second timing signal (TE2) is output.

Hereinafter, with reference to FIGS. 4 to 9, a method in which the DDIC 230 controls (e.g., increases) the output cycle and/or length of a timing signal (TE) and reduces image degradation (e.g., flicker) will be described in detail in the case that transmission of an image frame (IMG) from the processor 120 is delayed.

Figure 4:
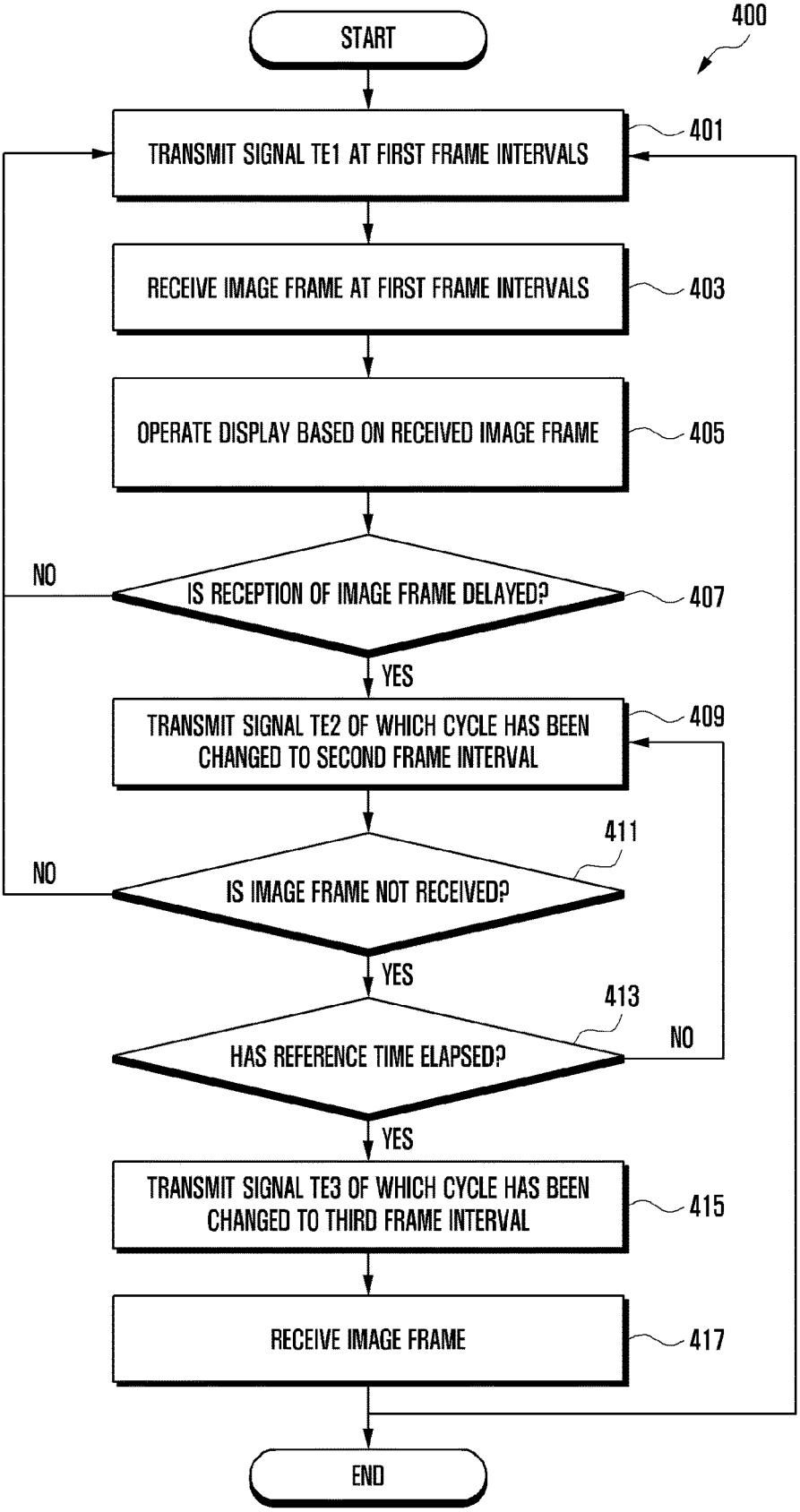
FIG. 4 is an operational flowchart of an electronic device according to an embodiment of the disclosure.

FIG. 4 is an operational flowchart of an electronic device according to an embodiment of the disclosure. For example, FIG. 4 may be an operational flowchart 400 of DDIC 230 according to an embodiment of the disclosure.

Figure 5:
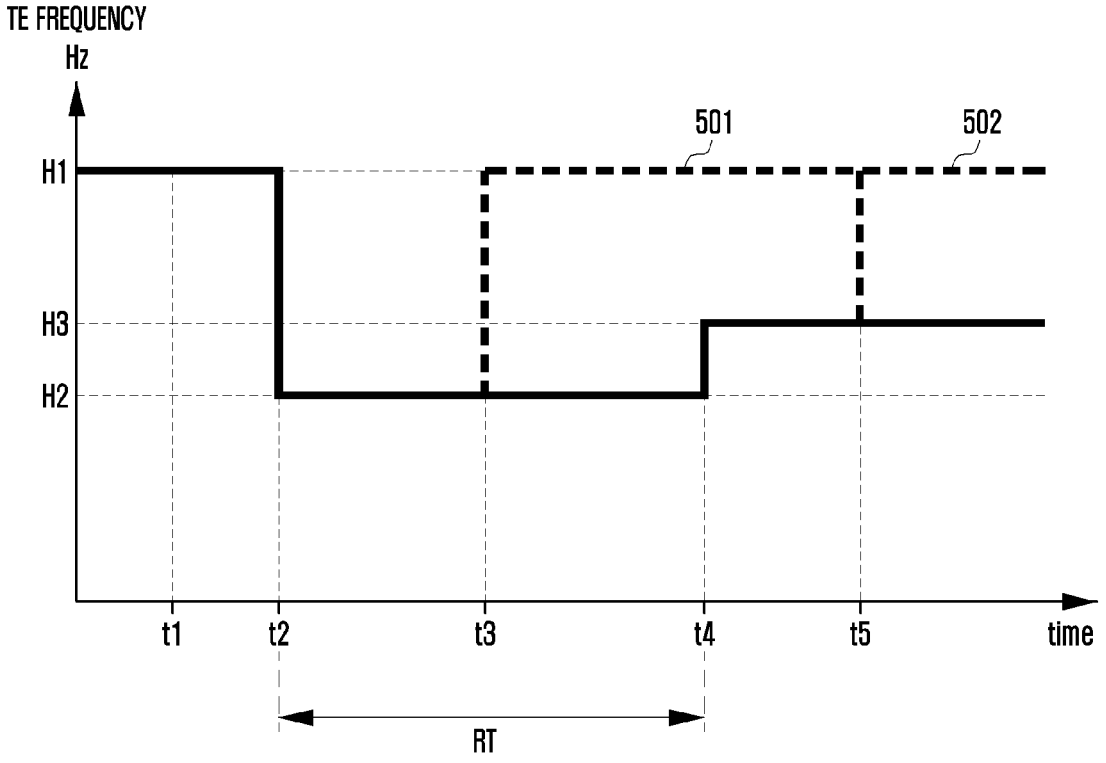
FIG. 5 is a graph illustrating an output frequency of a timing signal according to an embodiment of the disclosure.

FIG. 5 is a graph illustrating an output frequency of a timing signal (TE) according to an embodiment of the disclosure. For example, in the graph of FIG. 5, the horizontal axis denotes time and the vertical axis denotes the frequency of a timing signal (TE).

Referring to FIG. 4, in operation 401, a DDIC (e.g., the DDIC 230 of FIG. 3) according to an embodiment may transmit a first timing signal (TE1) to a processor (e.g., the processor 120 of FIG. 3) at designated first frame intervals (e.g., 60 Hz). For example, the first frame interval may be an interval corresponding to a normal state in which transmission of an image frame (IMG) from the processor 120 is not delayed. For example, in the case of transmission of an image frame (IMG) to the DDIC 230 by the processor 120, the state in which transmission is not delayed may be defined as the normal state.

According to an embodiment, in the case that the image frame (IMG) is received from the processor 120 at a designated timing (e.g., a next first frame interval), the DDIC 230 may consider the state a normal state, and may transmit a first timing signal (TE1) at the first frame intervals. For example, referring to point t1 of FIG. 5, in the case of the normal state, the DDIC 230 may transmit a first timing signal (TE1) at a designated first frequency (H1) corresponding to the first frame interval.

According to an embodiment, in the case that a second image frame (e.g., a second image frame (IMG2) of FIG. 6) is received after a next first frame interval from the point in time at which the first image frame (e.g., a first image frame (IMG1) of FIG. 6) is received, the DDIC 230 may consider the state the normal state, and may transmit a first timing signal (TE1). The second image frame (e.g., the second image frame (IMG2) of FIG. 6) may be an image frame subsequent to the first image frame (e.g., the first image frame (IMG1) of FIG. 6). For example, the processor 120 may render the first image frame (e.g., the first image frame (IMG1) of FIG. 6), and then may render the second image frame (e.g., the second image frame (IMG2) of FIG. 6). The processor 120 may transmit, to the DDIC 230, the first image frame (e.g., the first image frame (IMG1) of FIG. 6) and the second image frame (e.g., the second image frame (IMG2) of FIG. 6) in order of image frames rendered.

In operation 403, the DDIC 230 according to an embodiment may receive an image frame (IMG) from the processor 120 at the first frame intervals. For example, the processor 120 may be configured to render (or produce) an image frame (IMG) at the first frame intervals. The processor 120 may transmit, to the DDIC 230, a rendered image frame (IMG) in response to the first timing signal (TE1). The DDIC 230 may output the first timing signal (TE1) at the first frame intervals, and thus the processor 120 may transmit an image frame (IMG) at the first frame intervals.

In operation 405, the DDIC 230 according to an embodiment may operate a display (e.g., the display 210 of FIG. 3) (e.g., a display panel) based on the received image frame (IMG). For example, the DDIC 230 may operate the display 210 to display an image frame (IMG) received from the processor 120. According to an embodiment, the DDIC 230 may arrange a received image frame (IMG) to be appropriate for the characteristic (e.g., resolution) of a display panel, and/or may perform pre-processing or post-processing (e.g., adjustment of a resolution, a brightness, or a size) on the image frame (IMG) based on the characteristic of the display 210, so as to produce a converted image frame (e.g., a converted image frame (RGB) of FIG. 3). The DDIC 230 may operate the display 210 to display the converted image frame (e.g., a converted image frame (RGB) of FIG. 3).

Operations 401, 403, and 405 may be operations by the DDIC 230 corresponding to the normal state in which transmission of an image frame (IMG) from the processor 120 is not delayed.

In operation 407, the DDIC 230 according to an embodiment may determine whether reception of an image frame (IMG) is delayed. For example, in the case that a new image frame (IMG) is not received from the processor 120 at a designated timing, the DDIC 230 may determine that reception of an image frame (IMG) is delayed. In the case that the second image frame (IMG2) is not received at a time corresponding to a next first frame interval from the point in time at which the first image frame (IMG1) is received, and the second image frame (IMG2) is not received within a designated time, for example, a designated frame interval, the DDIC 230 may determine that reception of an image frame (IMG) is delayed.

In the case that the reception of an image frame (IMG) is not delayed (e.g., 'No' in operation 407), the DDIC 230 may perform operation 401.

In operation 409, in the case that reception of an image frame (IMG) is determined as being delayed (e.g., 'Yes' in operation 407), the DDIC 230 according to an embodiment may change the cycle of a timing signal (TE) and may output a second timing signal (TE2). For example, the DDIC 230 may output the second timing signal (TE2) at designated second frame intervals (e.g., 40 Hz). According to an embodiment, the second frame interval may be longer than the first frame interval. For example, referring to point t2 of FIG. 5, the DDIC 230 may transmit a second timing signal (TE2) at a designated second frequency (H2) corresponding to the second frame interval in the case that reception of an image frame (IMG) is delayed. The second frequency (H2) may be a lower frequency than the first frequency (H1) corresponding to the normal state.

According to an embodiment, in the electronic device 300 that operates in the command mode of the MIPI, a timing signal (TE) may be a signal that the DDIC 230 indicates, to a host (e.g., the processor 120), a transmission timing of an image frame (IMG). For example, the processor 120 that is a host may transmit an image frame (IMG) to the DDIC 230 in response to a timing signal (TE) output from the DDIC 230. In the case that transmission of an image frame (IMG) from the processor 120 is delayed, the DDIC 230 according to an embodiment may increase a timing at which the processor 120 is capable of transmitting an image frame (IMG) to the DDIC 230 by increasing an output cycle of a timing signal.

According to an embodiment, the second frame interval may be a threshold value at which flicker is not visible while the display 210 is displaying a video. For example, the DDIC 230 may adjust a refresh rate to the second frame interval by outputting a timing signal (TE) at the second frame intervals, and the adjusted refresh rate may be set to fall within a range in which flicker is not visible while the display 210 is displaying a video.

According to an embodiment, in the case that transmission of an image frame (IMG) from the processor 120 is delayed, the DDIC 230 may increase the length of an enable section of a timing signal (TE). For example, in the case that transmission of an image frame (IMG) from the processor 120 is delayed, the DDIC 230 may adjust a pulse width of a timing signal (TE). For example, the processor 120 may transmit an image frame (IMG) to the DDIC 230 while a timing signal (TE) is in an enable section. Therefore, when the DDIC 230 increases the length of the enable section of a timing signal (TE), the DDIC 230 may increase a timing at which the processor 120 is capable of transmitting an image frame (IMG) to the DDIC 230. For example, the first timing signal (TE1) that the DDIC 230 outputs in the normal state may have an enable section of a first length (e.g., a first length (m1) of FIG. 9). In the case that transmission of an image frame (IMG) from the processor 120 is delayed, the DDIC 230 may output the second timing signal (TE2) having an enable section of a second length (e.g., a second length (m1+m2) of FIG. 9) longer than the first length (e.g., the first length (m1) of FIG. 9).

According to an embodiment, the second length (e.g., the second length (m1+m2) of FIG. 9) in which the second timing signal (TE2) is enabled may be a threshold value at which flicker is not visible while the display 210 is displaying a video. For example, a section in which a timing signal (TE) is enabled may be a section in which the processor 120 transmits an image frame (IMG) to the DDIC 230, and may indicate a display status associated with a vertical blanking period between frames. For example, in the case that a section in which a timing signal (TE) is enabled is increased, a vertical blanking period may be increased, and in the case that the vertical blanking period is increased to be greater than or equal to a threshold value, flicker may be visible. According to an embodiment, the second length (e.g., the second length (m1+m2) of FIG. 9) may set to a designated threshold value to prevent the flicker from occurring while the display 210 is displaying a video.

Referring to FIGS. 4 and 5, in operation 411, the DDIC 230 according to an embodiment may identify whether an image frame (IMG) is not received while the second timing signal (TE2) is output. In the case that reception of an image frame (IMG) is received (e.g., 'No' in operation 411), the DDIC 230 may proceed with operation 401. For example, as shown in graph 501 corresponding to point t3 of FIG. 5, the DDIC 230 may increase the cycle and/or length of a timing signal (TE), and then if an image frame (IMG) is received, may proceed with operation 401 so as to restore the cycle and/or length of the timing signal (TE) to a value (e.g., a first frequency (H1) of FIG. 5) corresponding to the normal state.

In operation 413, if an image frame (IMG) is not received (e.g., 'Yes' in operation 411) while the second timing signal (TE2) is output, the DDIC 230 according to an embodiment may identify whether a designated reference time (e.g., a reference time (RT) of FIG. 5) has elapsed. For example, the reference time (RT) may be a designated frame. The DDIC 230 may count the time that elapses from the point in time at which the second timing signal (TE2) is output for the first time, and may identify whether the time reaches the reference time (RT).

In the case that the reference time (RT) does not elapse ('No' in operation 413), the DDIC 230 according to an embodiment may proceed with operation 409.

In operation 415, in the case that the reference time (RT) has elapsed ('Yes' in operation 413), the DDIC 230 according to an embodiment may change the cycle of a timing signal (TE) and may output a third timing signal (TE3). For example, the DDIC 230 may output the third timing signal (TE3) at designated third frame intervals (e.g., 50 Hz). According to an embodiment, the third frame interval may be longer than the first frame interval, and may be shorter than the second timing signal (TE2). For example, referring to point t4 of FIG. 5, in the case that the reference time (RT) has elapsed, the DDIC 230 may transmit the third timing signal (TE3) at a designated third frequency (H3) corresponding to the third frame interval. The third frequency (H3) may be a lower frequency than the first frequency (H1) corresponding to the normal state, and may be a higher frequency than the second frequency.

According to an embodiment, the third frame interval may be a threshold value at which flicker is not visible while the display 210 is displaying a still image. For example, the DDIC 230 may adjust a refresh rate to the third frame interval by outputting a timing signal (TE) at the third frame intervals, and the adjusted refresh rate may be set to fall within a range in which flicker is not visible while the display 210 is displaying a still image.

According to an embodiment, in the case that a reference time (RT) has elapsed, the DDIC 230 may adjust the length of an enable section of a timing signal (TE). For example, the DDIC 230 may adjust the pulse width of a timing signal (TE). For example, the DDIC 230 may output the third timing signal (TE3) having an enable section of a third length (e.g., m1+m3 of FIG. 9) that is longer than the first length (e.g., m1+m2 of FIG. 9) and is shorter than the second length (e.g., m1+m3 of FIG. 9).

According to an embodiment, the third length (e.g., m1+m3 of FIG. 9) in which the third timing signal (TE3) is enabled may be a threshold value at which flicker is not visible while the display 210 is displaying a still image. For example, a section in which a timing signal (TE) is enabled may be a section in which the processor 120 transmits an image frame (IMG) to the DDIC 230, and may indicate a display status associated with a vertical blanking period between frames. According to an embodiment, the third length (e.g., m1+m3 of FIG. 9) may set to a designated threshold value which prevents the flicker from occurring while the display 210 is displaying a still image.

Referring to FIGS. 4 and 5, in operation 417, the DDIC 230 according to an embodiment may proceed with operation 401 in the case that an image frame (IMG) is received while the third timing signal (TE3) is output. For example, as shown in graph 502 corresponding to point t5 of FIG. 5, the DDIC 230 may output the third timing signal (TE) obtained by adjusting the cycle and/or length of a timing signal (TE), and then if an image frame (IMG) is received, may proceed with operation 401 so as to restore the cycle and/or length of the timing signal (TE) to a value (e.g., a first frequency (H1) of FIG. 5) corresponding to the normal state.

According to an embodiment, the DDIC 230 may output the third timing signal (TE3) until an image frame (IMG) is received.

FIG. 6 is a graph illustrating an operation timing of an electronic device according to an embodiment of the disclosure. For example, graph 601 of FIG. 6 illustrates the state in which a processor (e.g., the processor 120 of FIG. 3) renders an image frame (IMG). Graph 602 may be a graph illustrating a timing of a timing signal (TE) output from a DDIC (e.g., the DDIC 230 of FIG. 3). Graph 603 may be a graph illustrating a timing at which the processor 120 transmits a rendered image frame (IMG) to the DDIC 230 via an MIPI DSI.

Referring to graph 601 of FIG. 6, a section in a "high state (H)" may be a section in which the processor 120 is rendering an image. For example, in the illustrated example, the fact that the length of a section in which a second image frame (IMG2) is rendered is longer than the length of a section in which a first image frame (IMG1) is rendered may indicate that rendering of the second image frame (IMG2) by the processor 120 is being delayed.

Referring to graph 602 of FIG. 6, a section in a "high state (H)" may be a section in which a timing signal (TE) is output from the DDIC 230. For example, in graph 602, the section in a "high state (H)" may be a section in which a timing signal (TE) is in an enable state. Referring to graph 603, the processor 120 may transmit a rendered image frame (IMG) to the DDIC 230 in a section in which a timing signal (TE) is in an enable state.

Referring to graph 603 of FIG. 6, a section in a "high state (H)" may be a section in which the processor 120 transmits a rendered image frame (IMG) to the DDIC 230 in response to a timing signal (TE). In graph 603, a section in a "low state (L)" may be a delayed state in which the processor 120 is incapable of transmitting a rendered image frame (IMG) in response to a timing signal (TE).

Referring to FIG. 6, the processor 120 may execute an application, and may sequentially render a plurality of image frames (IMG) corresponding to an execution screen of the executed application. For example, the processor 120 may sequentially render image frames (IMG) (e.g., IMG0, IMG1, IMG2, . . . IMGn) corresponding to the execution screen.

According to an embodiment, the processor 120 may transmit image frames (IMG) of which rendering has been completed to the DDIC 230 in response to a timing signal (TE). For example, the processor 120 may sequentially transmit IMG0, IMG1, IMG2 . . . IMGn that are image frames (IMG) corresponding to the execution screen.

According to an illustrated example, the processor 120 may experience a delay in rendering the second image frame (IMG2), and at point 611, the processor 120 may fail to transmit the second image frame (IMG2) after transmitting the first image frame (IMG1). According to an embodiment, the DDIC 230 may identify that the second image frame (IMG2) is not received after a period of time (e.g., 1/60 seconds) corresponding to a first frame interval (e.g., 60 Hz) from the point in time at which the first image frame (IMG1) is received. According to an embodiment, as shown in reference numeral 612, in the case that the second image frame (IMG2) is not received within a designated period of time (e.g., designated k frames), the DDIC 230 may determine that reception of an image frame (IMG) is delayed. In the case that the reception of an image frame (IMG) is determined as being delayed, the DDIC 230 may output a timing signal (TE) at second frame intervals (e.g., 40 Hz) longer than the first frame interval. For example, the cycle of a first timing signal (TE1) that the DDIC 230 outputs in the normal state may be "n1" as illustrated in FIG. 6. The cycle of a second timing signal (TE2) that the DDIC 230 outputs in the state in which transmission of an image frame (IMG) from the processor 120 is delayed may be "n1+n2" as illustrated in FIG. 6.

According to an embodiment, the DDIC 230 may count an elapse time from the point in time (e.g., point t2 of FIG. 5) at which the second timing signal (TE2) is output for the first time, and may identify whether the elapse time reaches a reference time (e.g., reference time (RT) of FIG. 5). In the case that the reference time (RT) has elapsed as indicated by reference numeral 613 of FIG. 6, the DDIC 230 may output a third timing signal (TE3) by changing a timing signal (TE). For example, the DDIC 230 may output the third timing signal (TE3) at designated third frame intervals (e.g., 50 Hz). According to an embodiment, the third frame interval may be longer than the first frame interval and may be shorter than the second timing signal (TE2). The cycle of the third timing signal (TE3) that the DDIC 230 outputs in the state in which transmission of an image frame (IMG) from the processor 120 continues being delayed (e.g., in the state in which a reference time (RT) has elapsed) may be "n1+n3" as illustrated in FIG. 6. Here, "n1+n3" may be shorter than "n1+n2."

Figure 7:
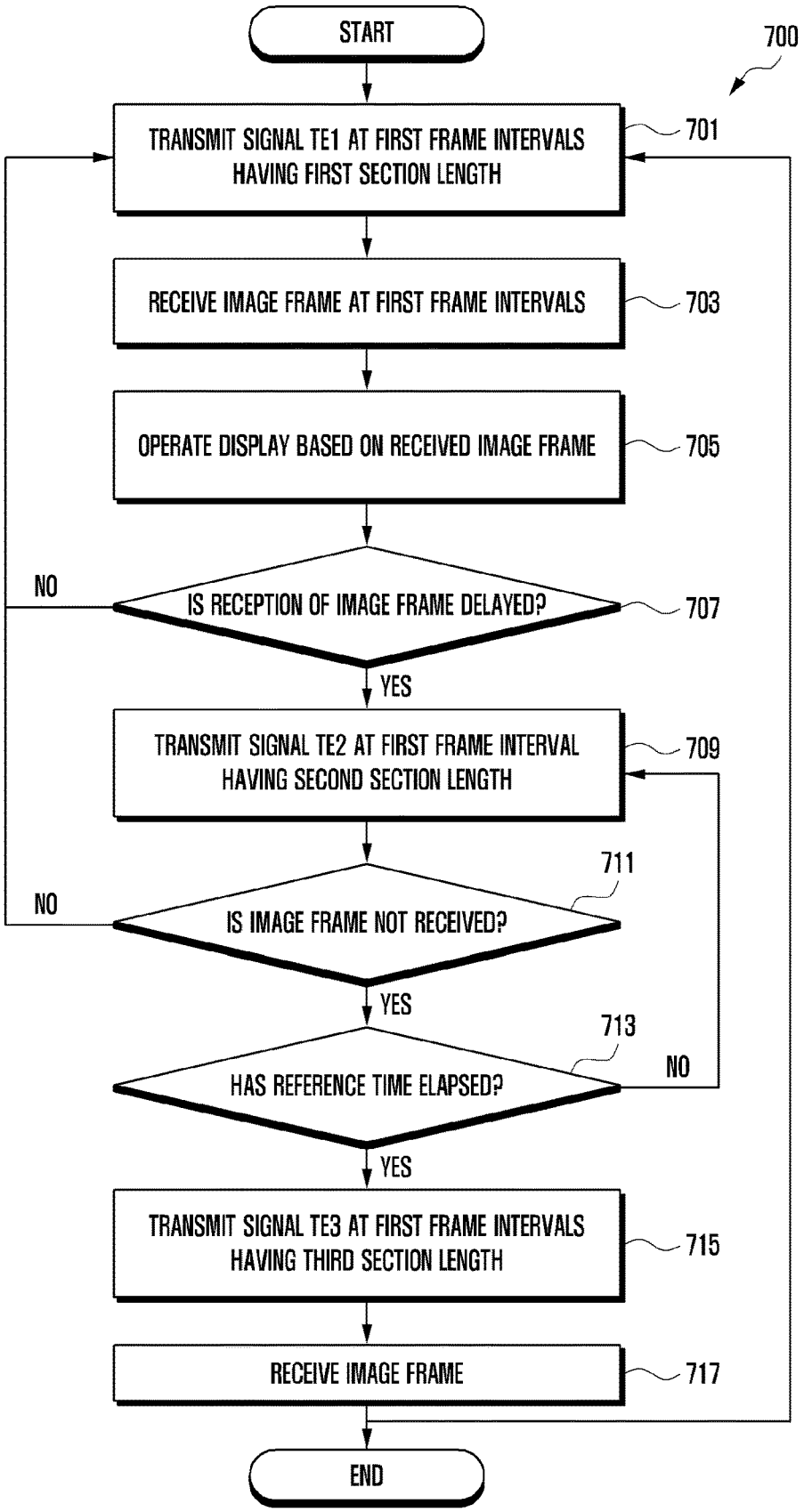
FIG. 7 is an operational flowchart of an electronic device according to an embodiment of the disclosure.

FIG. 7 is an operational flowchart of an electronic device according to an embodiment of the disclosure. For example, FIG. 7 may be an operational flowchart 700 of DDIC 230 according to another embodiment of the disclosure.

Figure 8:
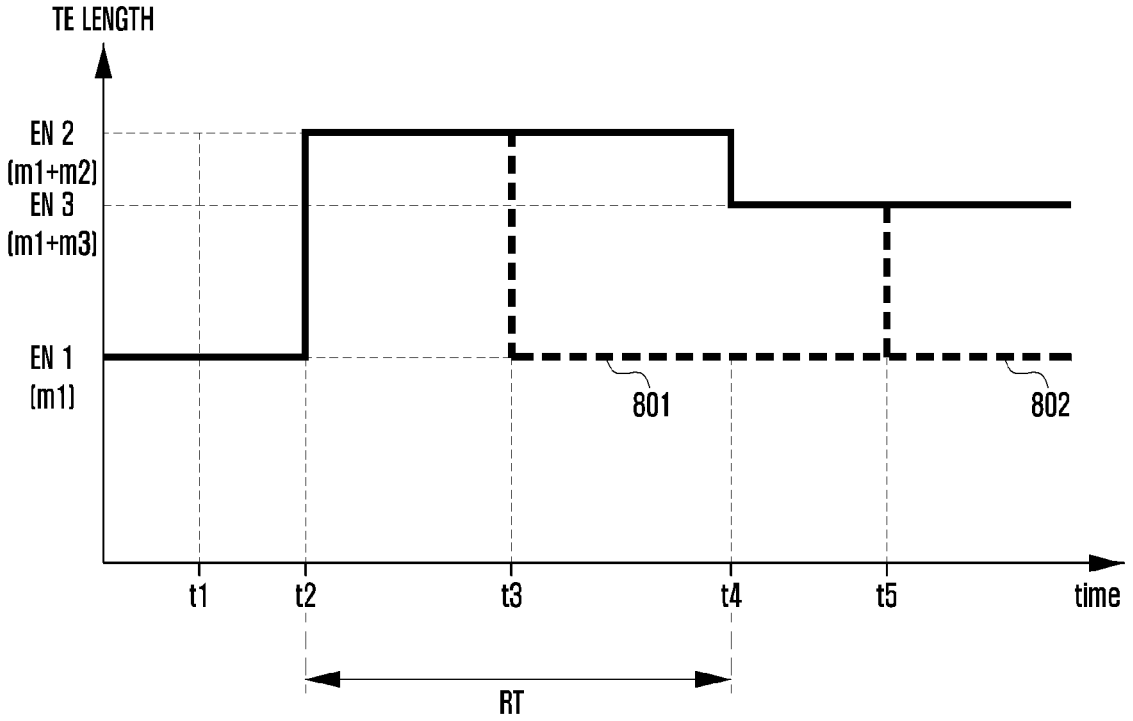
FIG. 8 is a graph illustrating adjustment of the length of an enable section of a timing signal according to an embodiment of the disclosure.

FIG. 8 is a graph illustrating adjustment of the length of an enable section of a timing signal (TE) according to an embodiment of the disclosure.

Referring to FIG. 7, operations 701, 703, 705, and 707 may be identical or similar to operations 401, 403, 405, and 407 illustrated in FIG. 4. For example, operation 701 may be identical or similar to operation 401 illustrated in FIG. 4. Operation 703 may be identical or similar to operation 403 illustrated in FIG. 4. Operation 705 may be identical or similar to operation 405 illustrated in FIG. 4. Operation 707 may be identical or similar to operation 407 illustrated in FIG. 4. Hereinafter, only operations of FIG. 7 that have differences when compared to operations of FIG. 4 will be described.

In operation 709, in the case that reception of an image frame (IMG) is not determined as being delayed (e.g., 'No' in operation 707) the operation proceeds to operation 701, and in the case that reception of an image frame (IMG) is determined as being delayed (e.g., 'Yes' in operation 707), an DDIC (e.g., DDIC 230 of FIG. 3) according to an embodiment may change the length of a timing signal (TE) and may output a second timing signal (TE2). In the case that transmission of an image frame (IMG) from a processor (e.g., the processor 120 of FIG. 3) is delayed, the DDIC 230 may increase the length of an enable section of a timing signal (TE). For example, in the case that transmission of an image frame (IMG) from the processor 120 is delayed, the DDIC 230 may adjust a pulse width of a timing signal (TE). When the DDIC 230 increases the length of the enable section of the timing signal (TE), a timing at which the processor 120 is capable of transmitting an image frame (IMG) to the DDIC 230 may be increased. For example, referring to FIG. 8, a first timing signal (TE1) that the DDIC 230 outputs in the normal state may have an enable section of a first length (e.g., a first length (EN1) of FIG. 8). As shown at point t2 of FIG. 8, in the case that transmission of an image frame (IMG) from the processor 120 is delayed, the DDIC 230 may output a second timing signal (TE2) having an enable section of a second length (e.g., a second length (EN2) of FIG. 8) longer than the first length (EN1).

According to an embodiment, the second length (EN2) in which the second timing signal (TE2) is enabled may be a threshold value at which flicker is not visible while the display 210 is displaying a video.

According to an embodiment, the DDIC 230 may additionally change the cycle of a timing signal (TE). For example, the DDIC 230 may output the second timing signal (TE2) at designated second frame intervals (e.g., 40 Hz). According to an embodiment, the second frame interval may be longer than the first frame interval. For example, referring to point t2 of FIG. 5, the DDIC 230 may transmit the second timing signal (TE2) at a designated second frequency (H2)

corresponding to the second frame interval in the case that reception of an image frame (IMG) is delayed. According to an embodiment, the second frame interval may be a threshold value at which flicker is not visible while the display 210 is displaying a video.

In operation 711, the DDIC 230 according to an embodiment may identify whether an image frame (IMG) is not received while the second timing signal (TE2) is output. In the case that reception of an image frame (IMG) is received (e.g., 'No' in operation 711), the DDIC 230 may perform operation 701. For example, as shown in graph 801 corresponding to point t3 of FIG. 8, the DDIC 230 may increase the length of a timing signal (TE) and then, if an image frame (IMG) is received, may proceed with operation 701 so as to restore the length of the timing signal (TE) to a value (e.g., a first frequency (EN1) of FIG. 8) corresponding to the normal state.

In operation 713, in the case that an image frame (IMG) is not received (e.g., 'Yes' in operation 711) while the second timing signal (TE2) is output, the DDIC 230 according to an embodiment may identify whether a designated reference time (RT) has elapsed. For example, the reference time (RT) may be a designated frame. The DDIC 230 may count an elapse time from the point in time at which the second timing signal (TE2) is output for the first time, and may identify whether the elapse time reaches the reference time (RT).

In the case that the reference time (RT) does not elapse ('No' in operation 713), the DDIC 230 according to an embodiment may proceed with operation 709. In operation 713, in the case that the reference time (RT) has elapsed (e.g., "Yes" in operation 713), operation 715 may be performed.

In operation 715, the DDIC 230 according to an embodiment may output a signal (TE3) when the reference time (RT) has elapsed. For example, as shown at point t4 of FIG. 8, in the case that the reference time (RT) elapses, the DDIC 230 may output a third timing signal (TE3) having an enable section of a third length (e.g., a third length (EN3) of FIG. 8) that is longer than the first length (EN1) and is shorter than the second length (EN2).

According to an embodiment, the third length (EN3) in which the third timing signal (TE3) is enabled may be a threshold value at which flicker is not visible while the display 210 is displaying a still image.

According to an embodiment, the DDIC 230 may additionally change the cycle of a timing signal (TE). For example, the DDIC 230 may output the third timing signal (TE3) at designated third frame intervals (e.g., 50 Hz). According to an embodiment, the third frame interval may be longer than the first frame interval, and may be shorter than the second frame interval. For example, referring to point t4 of FIG. 5, in the case that the reference time (RT) has elapsed, the DDIC 230 may transmit the third timing signal (TE3) at a designated third frequency (H3) corresponding to the third frame interval.

According to an embodiment, the third frame interval may be a threshold value at which flicker is not visible while the display 210 is displaying a still image.

In operation 717, the DDIC 230 according to an embodiment may proceed with operation 701 in the case that an image frame (IMG) is received from the processor 120 while the third timing signal (TE3) is output. For example, as shown in graph 802 corresponding to point t5 of FIG. 8, the DDIC 230 may output the third timing signal (TE3) obtained by adjusting the length of a timing signal (TE) and then, if an image frame (IMG) is received, may proceed with operation 701 so as to restore the length of the timing signal (TE) to a value (e.g., the first length (EN1) of FIG. 8) corresponding to the normal state.

FIG. 9 is a graph illustrating an operation timing of an electronic device according to an embodiment of the disclosure. For example, graph 901 of FIG. 9 illustrates the state in which the processor 120 renders an image frame (IMG). Graph 902 may be a graph illustrating a timing of a timing signal (TE) output from the DDIC 230. Graph 903 is a graph illustrating a timing at which the processor 120 transmits a rendered image frame (IMG) to the DDIC 230 via an MIPI DSI.

Referring to graph 901 of FIG. 9, a section in a "high state (H)" may be a section in which the processor 120 is rendering an image. For example, in the illustrated example, the fact that the length of a section in which a second image frame (IMG) is rendered is longer than the length of a section in which a first image frame (IMG1) is rendered may indicate that rendering of a second image frame (IMG) by the processor 120 is being delayed.

Referring to graph 902 of FIG. 9, a section in a "high state (H)" may be a section in which a timing signal (TE) is output from the DDIC 230. For example, in graph 602, the section in a "high state (H)" may be a section in which a timing signal (TE) is in an enable state. Referring to graph 603, the processor 120 may transmit a rendered image frame (IMG) to the DDIC 230 in a section in which a timing signal (TE) is in an enable state.

Referring to graph 903 of FIG. 9, a section in a "high state (H)" may be a section in which the processor 120 transmits a rendered image frame (IMG) to the DDIC 230 in response to a timing signal (TE). In graph 903, a section in a "low state (L)" may be a delayed state in which the processor 120 is incapable of transmitting a rendered image frame (IMG) in response to a timing signal (TE).

Referring to FIG. 9, a processor (e.g., the processor 120 of FIG. 3) may execute an application, and may sequentially render a plurality of image frames (IMG) corresponding to an execution screen of the executed application. For example, the processor 120 may sequentially render IMG0, IMG1, IMG2 . . . IMGn that are image frames (IMG) corresponding to the execution screen.

According to an embodiment, the processor 120 may transmit image frames (IMG) of which rendering has been completed to a DDIC (e.g., the DDIC 230 of FIG. 3) in response to a timing signal (TE). For example, the processor 120 may sequentially transmit IMG0, IMG1, IMG2 . . . IMGn that are image frames (IMG) corresponding to the execution screen.

According to an illustrated example, the processor 120 may experience a delay in rendering the second image frame (IMG2), and thus, at point 911, the processor 120 may fail to transmit the second image frame (IMG2) after transmitting the first image frame (IMG1). According to an embodiment, the DDIC 230 may identify that the second image frame (IMG2) is not received after a period of time (e.g., 1/60 seconds) corresponding to a first frame interval (e.g., 60 Hz) from the point in time at which the first image frame (IMG1) is received. As shown in reference numeral 912, in the case that the second image frame (IMG2) is not received within a designated period of time, for example, in the case that the second image frame (IMG2) is not received within designated k frames, the DDIC 230 may determine that reception of an image frame (IMG) is delayed.

According to an embodiment, in the case that reception of an image frame (IMG) is determined as being delayed, the DDIC 230 may output a second timing signal (TE2) by changing the length (e.g., pulse width) of the timing signal (TE). For example, while an image frame (IMG) is normally received, the DDIC 230 may output a first timing signal (TE1) having an enable section of a first length (m1), and when determining that reception of an image frame (IMG) is delayed, may output a second timing signal (TE2) having an enable section of a second length (m1+m2) longer than the first length (m1). For example, as illustrated in FIG. 9, the first length may be "m1", and the second length "m1+m2".

According to an embodiment, the DDIC 230 may count an elapse time from the point in time (e.g., point t2 of FIG. 9) at which the second timing signal (TE2) is output for the first time, and may identify whether the elapse time reaches a reference time (e.g., a reference time (RT) of FIG. 9). In the case that the reference time (RT) has elapsed as indicated by reference numeral 913 of FIG. 9, the DDIC 230 may output a third timing signal (TE3) by changing the length of a timing signal (TE). For example, the DDIC 230 may output a third timing signal (TE3) having a third length (m1+m3) that is longer than the first length (m1) and is shorter than the second length (m1+m2). The length of the third timing signal (TE3) that the DDIC 230 outputs in the state in which transmission of an image frame (IMG) from the processor 120 continues being delayed (in the state in which a reference time (RT) has elapsed) may be "m1+m3" as illustrated in FIG. 9. Here, "m1+m2" may be shorter than "m1+m3".

In the case that transmission of an image frame (IMG) from the processor 120 is delayed, the DDIC 230 of the electronic device 300 according to various embodiments may increase a timing at which the processor 120 is capable of transmitting an image frame (IMG) to the DDIC 230 by increasing the output cycle and/or length of a timing signal (TE). The DDIC 230 may be capable of relatively promptly receiving a new image frame (IMG), and thus various embodiments of the disclosure may reduce flicker.

In the case that transmission of an image frame (IMG) is delayed, the DDIC 230 of the electronic device 300 according to various embodiments may adjust the output cycle and/or length of a timing signal (TE) to a first threshold value at which the flicker does not occur while the display 210 is displaying a video. In addition, in the case that transmission of an image frame (IMG) is delayed until a reference time (RT) elapses even after the output cycle and/or length of a timing signal (TE) is adjusted to the first threshold value, the DDIC 230 may adjust the output cycle and/or length of a timing signal (TE) to a second threshold value at which the flicker does not occur while the display 210 displays a still image. As described above, various embodiments of the disclosure may adjust a timing signal (TE) that controls the refresh rate of the display 210 to the first threshold value or the second threshold value, and may reduce degradation (e.g., Motion Judder) of an image quality that is caused by a frame drop exceeding the limitation of a display panel.

The DDIC 230 of the electronic device 300 according to various embodiments may include a plurality of threshold values such as the output cycle and/or length of a timing signal (TE), so that degradation of an image may not occur when the display 210 is displaying a video. For example, based on delay of transmission of an image frame (IMG), the DDIC 230 may adjust a timing signal (TE), which controls the refresh rate of the display 210, by using at least one of the plurality of threshold values, thereby reducing degradation of an image of the display 210.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:
a memory storing an application;
a display driver integrated circuit (IC);
a display; and
a processor configured to:
execute the application,
produce an image frame corresponding to an execution screen of the application,
in response to a timing signal being output from the display driver IC, transmit the image frame to the display driver IC, and
perform control so that the display driver IC operates the display based on the image frame,
wherein the display driver IC is configured to:
output a first timing signal at designated first frame intervals,
in case that reception of the image frame from the processor is delayed, output a second timing signal at designated second frame intervals, each second frame interval being longer than each first frame interval, and
in case that the image frame is not received from the processor within a designated reference amount of time from a second point in time at which the second timing signal is output, output a third timing signal at designated third frame intervals, each third frame interval being longer than each first frame interval and shorter than each second frame interval.

2. The electronic device of claim 1, wherein the display driver IC is further configured to:
in case that the image frame is not received from the processor within a designated period of time from a first point in time at which the first timing signal is output, output the second timing signal.

3. The electronic device of claim 1, wherein the display driver IC is further configured to:
in case that the image frame is received from the processor while the second timing signal is output, output the first timing signal at the first frame intervals.

4. The electronic device of claim 1, wherein the display driver IC is further configured to:
in case that the image frame is received from the processor while the third timing signal is output, output the first timing signal at the first frame intervals.

5. The electronic device of claim 1,
wherein the display driver IC comprises a buffer memory storing a previously received image frame, and
wherein the display driver IC is further configured to:
in case that reception of the image frame from the processor is delayed, operate the display to display the previously received image frame.

6. The electronic device of claim 1,
wherein the processor and the display driver IC are connected via a mobile industry processor interface-display serial interface (MIPI DSI), and
wherein the timing signal comprises a tearing effect (TE) signal.

7. The electronic device of claim 1, wherein the second frame intervals correspond to a threshold value at which flicker is not visible while the display displays a video.

8. The electronic device of claim 1, wherein the third frame intervals correspond to a threshold value at which flicker is not visible while the display displays a still image.

9. The electronic device of claim 1, wherein a first enable section of the first timing signal has a first length, wherein a second enable section of the second timing signal has a second length longer than the first length, and wherein a third enable section of the third timing signal has a third length longer than the first length and shorter than the second length.

10. The electronic device of claim 9, wherein the second length corresponds to a threshold value at which flicker is not visible while the display displays a video.

11. The electronic device of claim 9, wherein the third length corresponds to a threshold value at which flicker is not visible while the display displays a still image.

12. A method of operating an electronic device including a display driver integrated circuit (IC) and a processor, the method comprising:

producing, by the processor, an image frame corresponding to an execution screen of an application;

in response to a timing signal being output by the display driver IC, transmitting, by the processor, the image frame to the display driver IC; and operating, by the display driver IC, a display based on the image frame, wherein the outputting of the timing signal by the display driver IC comprises:

outputting, by the display driver IC, a first timing signal at designated first frame intervals, in case that reception of the image frame from the processor is delayed, outputting, by the display driver IC, a second timing signal at designated second frame intervals, each second frame interval being longer than each first frame interval, and in case that the image frame is not received from the processor within a designated reference amount of time from a point in time at which the second timing signal is output, outputting, by the display driver IC, a third timing signal at designated third frame intervals, each third frame interval being longer than each first frame interval and shorter than each second frame interval.

13. The method of claim 12, further comprising:

in case that the image frame is not received from the processor within a designated period of time from a point in time at which the first timing signal is output, outputting, by the display driver IC, the second timing signal.

14. The method of claim 12, further comprising:

in case that the image frame is received from the processor while outputting the second timing signal, outputting, by the display driver IC, the first timing signal at the first frame intervals.

15. The method of claim 12, further comprising:

in case that the image frame is received from the processor while outputting the third timing signal, outputting, by the display driver IC, the first timing signal at the first frame intervals.

* * * * *